US009359721B2

(12) United States Patent
Harris et al.

(10) Patent No.: US 9,359,721 B2
(45) Date of Patent: Jun. 7, 2016

(54) SOFT FEEL PRINTED FABRIC AND METHOD OF PRODUCING SAME

(71) Applicant: WestPoint Home LLC, New York, NY (US)

(72) Inventors: Billy Harris, Anderson, SC (US); Imran Ahmad Cheema, Tubli (BH); Akram Shahzad, East Riffa (BH); Gul Ahmad, Askar (BH)

(73) Assignee: WestPoint Home LLC, New York, NY (US)

( * ) Notice: Subject to any disclaimer, the term of this patent is extended or adjusted under 35 U.S.C. 154(b) by 213 days.

(21) Appl. No.: 13/802,221

(22) Filed: Mar. 13, 2013

(65) Prior Publication Data

US 2014/0259456 A1 Sep. 18, 2014

(51) Int. Cl.

| | |
|---|---|
| ***D06C 15/02*** | (2006.01) |
| ***D06L 1/14*** | (2006.01) |
| ***D06L 3/02*** | (2006.01) |
| ***D06M 15/333*** | (2006.01) |
| ***D06M 15/643*** | (2006.01) |
| ***D06M 15/705*** | (2006.01) |
| ***D06P 1/44*** | (2006.01) |
| ***D06P 1/52*** | (2006.01) |
| ***D06M 13/50*** | (2006.01) |
| ***D06M 13/503*** | (2006.01) |
| ***D06M 13/292*** | (2006.01) |
| ***D06P 5/00*** | (2006.01) |
| ***D06M 15/09*** | (2006.01) |
| ***D06M 15/11*** | (2006.01) |
| ***D06M 15/263*** | (2006.01) |
| ***D06M 15/70*** | (2006.01) |

(52) U.S. Cl.

CPC ..... *D06P 5/001* (2013.01); *D06C 15/02* (2013.01); *D06L 1/14* (2013.01); *D06L 3/02* (2013.01); *D06M 15/09* (2013.01); *D06M 15/11* (2013.01); *D06M 15/263* (2013.01); *D06M 15/333* (2013.01); *D06M 15/6436* (2013.01); *D06M 15/70* (2013.01); *D06P 1/44* (2013.01); *D06P 1/5257* (2013.01); *D06P 1/5292* (2013.01); *D06M 2200/40* (2013.01); *D06M 2200/50* (2013.01)

(58) Field of Classification Search

CPC ..... D06P 5/001; D06P 1/44; D06P 1/5257; D06P 1/5292; D06C 15/02; D06L 1/14; D06L 3/02; D06M 15/09; D06M 15/11; D06M 15/263; D06M 15/333; D06M 15/6436; D06M 15/705; D06M 2200/40; D06M 2200/50

See application file for complete search history.

(56) References Cited

U.S. PATENT DOCUMENTS

| | | | | |
|---|---|---|---|---|
| 2,980,488 | A * | 4/1961 | Kokorudz | 8/108.1 |
| 4,095,947 | A | 6/1978 | Wolf et al. | |
| 4,312,634 | A | 1/1982 | Katz | |
| 4,333,190 | A * | 6/1982 | Ruettiger et al. | 8/151 |
| 4,712,290 | A | 12/1987 | Lindsey | |
| 5,866,526 | A * | 2/1999 | Olsen et al. | 510/392 |
| 5,976,196 | A | 11/1999 | Cooper et al. | |
| 2001/0037529 | A1 | 11/2001 | Igarashi et al. | |
| 2002/0066145 | A1 * | 6/2002 | Gupta et al. | 8/478 |
| 2009/0226681 | A1 | 9/2009 | Wang | |
| 2009/0286302 | A1 | 11/2009 | Liu et al. | |
| 2012/0318051 | A1 | 12/2012 | Driscoll et al. | |

FOREIGN PATENT DOCUMENTS

| | | | |
|---|---|---|---|
| GB | 992518 | * | 5/1965 |
| GB | 1430174 | A | 3/1976 |
| WO | 2007049094 | A1 | 5/2007 |

OTHER PUBLICATIONS

DE 2008-G76397, 2008.*

International Search Report corresponding to International Application No. PCT/US14/25497, mailed Jul. 7, 2014, citations listed above (3 pgs.).

Written Opinion corresponding to International Application No. PCT/US14/25497, mailed Jul. 7, 2014 (7 pgs.).

* cited by examiner

*Primary Examiner* — Amina Khan

(74) *Attorney, Agent, or Firm* — Loeb & Loeb LLP

(57) ABSTRACT

Woven, unfinished textiles or yarns may be made softer and more brightly-colored by a method which comprises treating a yarn to weave fabric by sizing the yarn to weave fabric; desizing the sized fabric; bleaching the desized fabric; reducing the number of electrolytes on the bleached fabric; pre-softening the fabric having fewer electrolytes; fabric printing the pre-softened fabric; and finishing the fabric printed fabric. A fabric printed textile comprising a self cross-linked low glass transition temperature acrylic binder film on fibers of a fabric printed textile, where the fibers are impregnated with a polysiloxane polymer.

23 Claims, 2 Drawing Sheets

SOFT FEEL PRINTED FABRIC AND METHOD OF PRODUCING SAME

FIELD OF THE INVENTION

The present disclosure is generally directed to a fabric printed textile having a soft handle or touch, and an improved method of producing such a textile.

BACKGROUND

There are many different textile production techniques currently available. These different techniques vary depending upon various factors including the nature of the color and application method. The dye class may be selected subject to the nature of the fiber, customer's demand, color brilliance and depth. Other factors impacting the choice of textile production techniques may include the percentage coverage of pattern and hand feel requirements.

There is a significant demand in the textile industry for brightly-colored textiles woven with a soft handle or touch. However, present methods for manufacturing such soft, brightly-colored textiles produce excess waste in the form of costs for using excess resources, time, and actual waste product produced.

For 100% cotton textiles, for example, the currently accepted technology utilizes the class of dyestuffs known as reactive dyes. Reactive dyes are a class of dyestuffs consisting of a chromophore (colored molecule) with a reactive linkage that fixes the chromophore to the hydroxyl site on a cellulose molecule. In order to achieve this fixation, however, there are several disadvantages. Although reactive printing accommodates soft hand and color brilliance, a number of processing steps are required. Commercial processing typically requires multiple steps. However, these steps lead to heavy additional costs added to the overall process due to the requirement of multiple rinsing and/or drying steps required between the respective stages. The additional rinse and/or drying steps add enormous additional costs and waste materials to the treatment process. Due to its lengthy processing route, which includes desizing, scouring, bleaching, mercerizing, printing, steaming, washing, drying, and finishing, where multiple washes occur in between several of the steps, the cost for using substantial amounts of energy, water, and chemicals is also high.

The desizing step may occur separately or in combination with other stages of the process used to pre-treat the yarn to weave fabrics prior to subsequent processing. Desizing typically comprises the use of enzymatic agents or oxidants. A chemical system is employed to depolymerize the polymer used during the sizing step. The depolymerization reduces the viscosity of the polymeric material used in the sizing step and improves the removal potential; however, this is only achieved by using large amounts of washing water. Washing steps are necessary prior to and/or after the chemical treatment. One of the disadvantages of this method is the production of a high volume of effluent stream containing a low concentration of the soils removed from the textile, which, when treated for final disposal, have a chemical oxygen demand. The effluent stream is normally mixed with the other waste or effluent streams produced from the textile processing. The nature and total volume of the effluent results in long and complex treatment processes before final disposal is undertaken. Therefore, in addition to time and expenses related to resources and waste removal, the amount of time for a textile to proceed through the reactive printing process is lengthy, which decreases the number of batches of textile manufactured for eventual sale.

Alternatively, organic pigments are used in about 45 to 60% of total textile printing. Organic pigment particles are essentially glued to the fabric with the help of a binder, such as an acrylic polymer emulsion, in the presence of a synthetic thickener, which provides printable viscosity to the pigment and binder. This mixture is also known as print paste. Although shorter processes, which provide economic advantages exist, there are disadvantages to these short cuts. Typically the resulting textile has a stiff hand feel, poor crock and abrasion fastness. Thickeners are used in an amount of 2 to 3.5% by weight of print paste. However, all of the non-volatile materials in the thickener become part of a dried film of the textile, which has an adverse effect on hand feel. Moreover, during consumer or home laundering, these thickeners used in print paste lead to poor crock fastness and abrasion marks on the printed fabric.

Synthetic thickeners are also known to react with electrolytes resulting in decreased viscosity of the print paste. A viscosity of 20000 to 25000 cPs is typically required to achieve printing fine outlines on cotton substrates. Thus, a synthetic thickener-based printing system has to be absolutely free from electrolytes in order to print fine outlines on cotton substrate. In order to prevent decreased viscosity, the use of a thickener with the highest possible yield, i.e., larger molecular size thickener, is possible but only if electrolytes are avoided. In fact, the most important factor affecting printability of pigment is the presence of electrolytes on poorly prepared substrates. Electrolytes on substrates cause flushing, which can be substantially avoided by increasing the concentration of the thickener. But by increasing the concentration of the thickener the resulting print fabric is harsher. Binders have a greater film hardness also contributing to a hard hand feel. Moreover, since the thickeners are also incorporated into the film structure and are high polymers with numerous polar groups, they necessarily form a harder film.

Therefore, there is a need for an improved method of manufacturing a soft, brightly-colored textile. This method of textile printing would cost the manufacturer less by being a shorter process, use fewer resources such as water, energy, chemicals, and the like, produce less waste product for disposing, and increase the amount of resulting soft, brightly-colored textiles produced.

BRIEF SUMMARY

This need is met by the present invention where an improved method for textile processing and superior soft and brightly-colored textiles obtained therefrom are provided. It is therefore an object of the invention to provide a textile processing method devoid of the above deficiencies and a softer textile that may also be brightly colored.

One object of the invention relates to an improved method of textile processing, comprising: sizing a yarn to weave a fabric; desizing the sized fabric; bleaching the desized fabric; reducing the number of electrolytes on the bleached fabric with demineralized water; pre-softening the bleached fabric; fabric printing the pre-softened fabric; and finishing the fabric printed fabric.

Another object of the invention relates to a soft, brightly-colored textile produced by the method described here.

A further object relates to a fabric printed textile comprising: a self cross-linked low glass transition temperature acrylic binder film on fibers impregnated with a polysiloxane polymer.

Yet another object is directed to a method, comprising: obtaining a first color; determining that the first color has an average first particle size; determining that the first color has the same appearance as a color produced by at least a second pigment and a third pigment, wherein the at least second pigment and third pigment each has an average particle size smaller than the average first particle size; and selecting the at least second pigment and third pigment to produce a color having the same appearance as the first color.

DETAILED DESCRIPTION

Figure 1A:
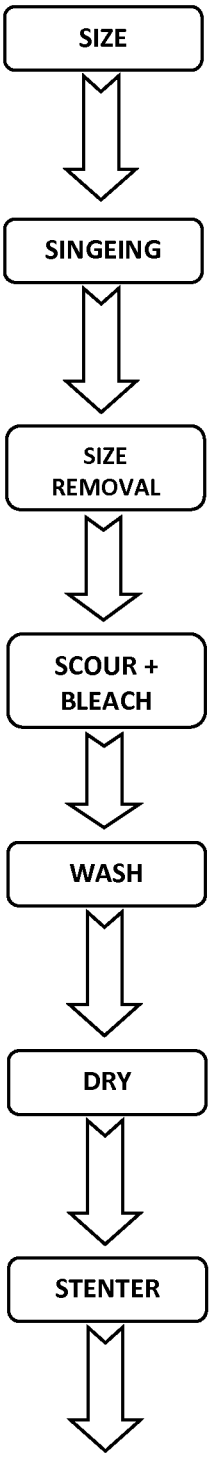
FIG. 1A and FIG. 1B show a flow chart of the textile processing method steps for producing a printed fabric with soft feel.
Figure 1B:
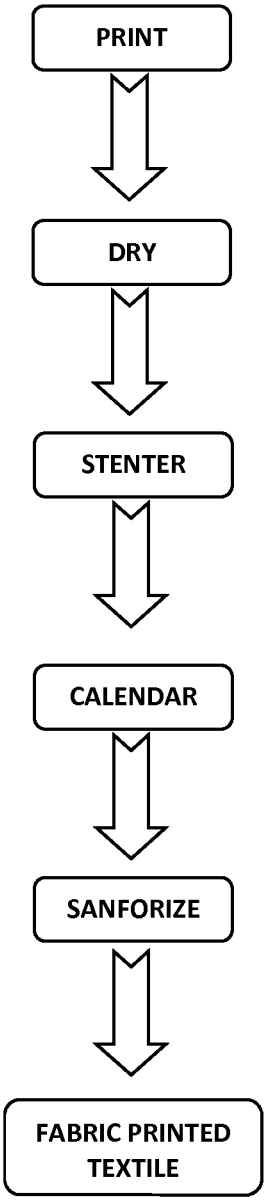

Embodiments of the present invention provide an improved textile treatment process for fabrics, particularly woven goods, that produces a fabric having superior softness and may be brightly colored. Present commercial textile preparation and processing methods for producing soft and brightly-colored fabric remain unsatisfactory due to the high costs associated with the waste produced from multiple washes, extra resources for the multiple-step treatments, and increased time to produce a final product.

Whereas, embodiments described here demonstrate a cost effective and superior alternative to conventional processing that results in a soft, brightly-colored fabric. The present invention involves fewer pre-treatment steps, removing extraneous washing steps, and uses alternative chemicals to achieve a fabric that is softer and more brightly-colored than what is currently available, particularly in mass-produced cotton fabrics.

Sizing

Sizing a fabric is important for providing an efficient weaving operation and successful production of grey fabric. Typically, sizing is used for stiffening yarn. Spinning lubricants may be in both the warp and weft; whereas, the size and size lubricant is predominantly found in the warp thread. Warp yarn threads are typically 'sized' prior to the weaving operation. The sizing procedure usually consists of applying a polymeric material or materials to the warp yarn and subsequently fixing these materials by drying. The polymeric materials may include starches, acrylics, polyvinyl alcohol, sodium carboxymethyl cellulose, polyvinyl acetate and/or mixtures thereof. The application of these materials improves the ability of the warp to resist the flexing and abrasive nature of the weaving process.

One embodiment of the invention relates to yarn sizing with a blend of recoverable polymers. Preferred sizing materials include those that are completely water soluble. Non-limiting examples of water soluble or recoverable, both of which are used interchangeably here, sizing materials include polyvinyl alcohol, polyvinyl acetate, sodium carboxymethyl cellulose, acrylic, or mixtures of such. In a preferred sizing step, a blend of partially hydrolyzed poly vinyl alcohol, Acrylic-vinyl acetate co-polymer, and castor oil-based softener may be used as the sizing material on warp yarn before the weaving process. The components of the sizing formulation described here was optimized to achieve better weave efficiency. For example, a blend of commercially available water soluble sizing materials for use in a preferred sizing step includes, but is not limited to, Arkofil® MSV.ID 200 liq (Clariant; Muttenz, Switzerland), Arkofil® STM gr (Clariant; Muttenz, Switzerland), and Trefix® MSW fla (Clariant; Muttenz, Switzerland). The sizing step also typically includes fixation by drying the sized yarn. Furthermore, after sizing and before desizing, the fabric is submitted to singeing. Singeing removes loose fibers protruding from the surface of a fabric. In doing so, the resulting fabric has a smoother surface, wettability, better dyeing characteristics, better clarity in printing, improved visibility of the fabric structure, less pilling and decreased contamination through removal of fluff and lint.

Desizing

After completion of the weaving process, the sizing products must be removed, to some degree, so that the subsequent textile processes are not adversely affected. This removal process is commonly known as the desizing stage. The process and materials used in desizing (i.e. the removal of the polymeric material used in the sizing process) varies depending on the nature of the polymeric material used in the sizing process. Typically, de-sizing comprises a washing process prior to and/or after a chemical treatment. It has previously been acknowledged in the field of de-sizing woven textiles that a chemical treatment of the fabric is required unless a completely water soluble sizing formulation (using products such as polyvinyl alcohol, polyvinyl acetate, sodium carboxymethyl cellulose, acrylics or mixtures thereof) has been applied to the warp during sizing. The de sizing procedure has therefore previously been carried out in two ways: 1) using enzymatic agents in an Enzymatic Desize; and 2) using oxidants in an Oxidative Desize.

In both of these prior art methods of desizing, a chemical system is employed to depolymerize the polymer used in the prior sizing step. Depolymerization reduces the viscosity of the polymeric material used and thereby improves the potential to remove the polymeric sizing material. However even after depolymerization, in order to remove the polymeric sizing material, large amounts of washing water is required to achieve this cleansing. The nature and total volume of the processors mixed effluent means long and complex treatment processes are typically required before sufficiently satisfactory removal of the polymer is achieved. While these prior art forms of depolymerization may still be used in some approaches to the present invention, they are preferably avoided to achieve maximum environmental benefit of the present invention—among other advantages that will become apparent to those of ordinary skill in the art having the present specification and claims before them.

Since the sizing materials are water soluble at a temperature of 208° F., another embodiment of the invention relates to desizing a woven, unfinished fabric that has been sized with water soluble or recoverably sizing materials by soaking the fabric in hot, ultra filtration-recovered water at a temperature ranging from about 208° F. to about 215° F. in a continuous wash box for less than one minute (and more specifically between about 37 seconds and about 55 seconds). The ultra filtration-recovered water may be recycled to reduce waste and resource usage. Desizing regardless of the time needed should be performed until the fabric attains a cleanliness rating ranging between 7-9 (TEGEWA-violet scale; Anna-Maria Janben-Taken and Mike Flatau. "Methods of evidence and determination on the fabric." *Handbook for Pretreatment,* 2008:46-47; available from CHT R. Beitlich GmbH; Tubingen, Germany; worldwideweb.cht.com), preferably level 9 which indicates a complete elimination of sizing materials and natural impurities (e.g. pectin, wax, proteins, ash or metals, and other organic impurities). Also desired is the cleansing or removal of metal impurities, including but not limited to, calcium, magnesium, iron, and manganese. Essentially, these impurities may be found in the outer cuticle of the primary cellular wall of the cotton fibers themselves. Typically, these impurites have been removed in prior art processes during an alkaline scouring process. While such methods may be used in certain embodiments of the presently inventive process, it is preferable to rely upon the process of soaking the fabric in hot, ultra filtration-recovered water at a temperature ranging from about 208° F. to about 215° F. in a continuous wash box for less than one minute (and more specifically between about 37 and about 55 seconds). Fabrics containing size and spinning lubricants and size materials are processing impurities that should also be removed. Desizing may be performed under similar conditions as that of the singeing step.

The desizing section of the bleaching machine preferably accommodates a vacuum slot installed at the end of the pre wash boxes to vacuum remove any remaining size material on fabric substrate. The vacuum slot is optimized to operate at 250 mBar in sufficient contact with the fabric substrate to get about 95% of size removal. Waste water recovered from prewashing (via the vacuum and otherwise may be collected and sent to an ultra filtration unit. This waste water contains about a 2% solution of Poly vinyl alcohol (PVA) and acrylic co polymer. The Ultra filtration unit membranes are selected to separate about 12% PVA solution (recovered PVA) from the water. The recovered water is called permeate and is sent to prewashes for reuse. Recovered PVA may also be recycled repeatedly for use in the sizing process.

Scouring and Bleaching

The combined scouring and bleaching steps immediately follows desizing the fabric. Bleaching the desized fabric occurs once preferably in a continuous wash box containing a bleach solution. However, other components/processes may be used so long as the desized fabric is substantially and sufficiently impregnated with the bleaching solution. A preferred bleaching solution comprises an oxidizing bleaching agent, a caustic soda, a bleaching stabilizer, and a wetting agent for bleaching that is "neutralized" with acetic acid to a pH of about 6.5 to about 7. A non-limiting example of a bleaching solution includes, about 30 ml/kg hydrogen peroxide 50%, about 30 ml/kg sodium hydroxide 49 Be, about 6 ml/kg of a preparation containing 20%-50% of a solution of carboxylate aminocarboxylate and phosphonates and sodium hydroxide (Hiroprep BQB; Allchem; Slough, United Kingdom), about 8 ml/kg of ethoxylated tridecyl alcohol (Hiroprep LMH; Allchem International Limited; Berkshire, United Kingdom) that has been neutralized with acetic acid to result in about pH 6.5 to about pH 7.

The fabric sufficiently impregnated with the bleaching solution enters into a steamer at a speed of about 80 meters/minute and remains within the steamer for a steam time of about 20 minutes to about 22 minutes at 208° F. The steamed fabric then enters a post washing process, which utilizes washing with demineralized water at a temperature of about 208° F. for about 60 seconds. The purpose of washing fabric with demineralized water (preferably having less than 50 ppm total dissolved solids) at this stage is to remove electrolytes to the extent possible during this short wash step. The electrolytes and minerals should substantially migrate from the fabric substrate to demineralized water since electrolytes and minerals readily move from high concentration to low concentration environments. In fact, since the fabric after steaming likely carries a high concentration of electrolytes and the demineralized water preferably used in the post-steam, washing step has fewer metal salts, the fabric is optimally demineralized. The presence of electrolytes was found to affect the hand or feel of fabric. Although most conventional textile processing methods may lose some electrolytes in washing steps, these conventional methods only desize a fabric to the acceptable of TEGEWA cleanliness level of 5. However, by desizing the fabric to a higher level, the electrolytes are substantially removed leading to a fabric with a softer feel. The bleaching machine may encompass several sections for performing many of the desired steps. However, the pre-treated fabric is preferably dried in a drying step prior to pre-softening.

The described method of sizing, desizing, bleaching, steam cleaning, and washing in demineralized water enables the fabric to obtain a TEGEWA cleanliness rating level of 9, which represents a complete desizing of the fabric. In addition to a resulting cleanliness level ranging from 7 to 9, preferably 9, the fabric conductivity is preferably less than 2000 μS (micro Siemens) as measured by a TDS meter. And still, the preferred embodiment described above still achieves a significant decrease in water and energy usage, a savings of about 75%.

Because of the relationship between the color intensity of an iodine starch complex and the residual starch content of a fabric sample, the TEGEWA-violet scale from 1 to 9 indicates a range of 1 that still has impurities to 9 which is completely desized. Briefly, the degree of desizing of a fabric may be determined by taking a fabric sample, applying an iodine solution for about one minute, rinsing with cold water, then dapping off with a starch-free filter paper, and comparing the fabric to the TEGEWA-violet scale. Conventional methods of sizing, desizing, scouring, and bleaching fabrics do not achieve a TEGEWA rating of 9. At most, the conventional methods result in a TEGEW rating of about 5 which is generally considered to be sufficient for dying purposes. Furthermore, conductivity of fabrics obtained by conventional methods cannot achieve conductivity of less than 2000 μS thus suggesting a higher than desirable level of electrolytes in these fabrics produced using prior art processes.

Generally, after the pre-treatment of fabric, mercerization occurs to improve the color yield of dyes in reactive printing. Mercerization is a strongly alkaline process with irreversible alterations of the physical characteristics and appearance of cellulosic fibers. Essentially, the fabric fibers are swollen during mercerization by submitting the fabric to a concentrated sodium hydroxide solution. Without being bound by theory, the sodium hydroxide and cellulose interact creating a series of physico-chemical modifications to the cellulosic fibers and thereby alters their properties entirely. The main modifications include the destruction of the cuticle, disappearance of the lumen, and the macromolecular structure of the cellulose is modified such that the fabric has a tendency to react with reactive dyes. Mercerization also results in a smooth fiber surface which provides luster to the fabric. While mercerization may still be used in some embodiments of the present invention, one of the disadvantages of using convention mercerization for reactive printing is the amount of effluent produced (about 4-6 L/kg of fabric). Moreover, each of the washes after desizing, scouring, and bleaching produces about 4-6 L/kg of fabric effluent. Thus, the total effluent produced using the conventional method is about 16-24 L/kg of fabric.

Pre-Softening

Alternatively, in another embodiment, instead of mercerization using an alkaline solution such as sodium hydroxide, a hydrophilic nano and micro particle silicon emulsion may be applied onto a stenter machine for application to the fabric. Because of the small particle size of the silicon emulsion ranging from about 5 nm to about 20 nm, the silicon particles may penetrate and impregnate the fibers of the fabric, thereby swelling the fibers. One of the benefits of using silicon to change the physico-chemical properties of the fiber (instead of alkaline mercerization techniques) is that the fabric response to crease recovery is improved and also provides a smoother surface on which to print fine lines and brighter colors. This pre-softening step of swelling the fibers with a silicon emulsion surprisingly contributes to the soft hand of the final printed fabric produced by the method described here.

The fabric may be evaluated for its smoothness appearance after repeated laundering using the AATCC 124 method (American Association of Textile Chemists and Colorists). The smoothness appearance (SA) of the conventional mercerized fabric was compared to that of the silicon pre-softening fabric using the AATCC 124 method. On a scale of SA-1, which indicates a crumpled, creased, and severely wrinkled appearance to SA-5, which indicates a very smooth, pressed and finished appearance, the silicon pre-softening fabric was better by a rating of 1 to ½ based on the different weave types and had a better handle than the mercerized fabric as observed by eight different people.

In contrast to the excess effluent produced by the convention methods, the preferred process described here, including sizing, de-sizing, combined scouring and bleaching, washing, drying, applying the silicone emulsion, and drying only produced an effluent of about 4-6 L/kg of fabric in total after the combined scouring and bleaching step. Moreover, this method preferably recycles the size recovered in the wash following the desizing step, so as to substantially minimize waste.

More specifically, the pre-softening hydrophilic nano and micro particle silicon emulsion preferably comprises about 5 g/L to about 10 g/L of a hydrophilic, quaternary, non-reactive polysiloxane macroemulsion, such as for example, an aminofunctional polysiloxane polymer emulsion also containing non-ionic surfactants and glycols with special handle, high stability, and improved sewability (Rucofin® GSQ; Rudolf Chemie; Geretsried, Germany); about 5 g/L to about 10 g/L of a cationic, amino-functional nano-silicone, such as for example, a polysiloxane polymer (Solusoft® SE 1 liq; Clariant; Muttenz, Switzerland), and about 2 g/L to about 3 g/L of a wetting agent for pretreatment of textiles, such as for example, an ethoxylated fatty alcohol phosphate and araliphatic ether alcohol based surfactant (Invadine® PBN; Huntsman Chemical; The Woodlands, Tex.). A preferred pre-softening silicon emulsion comprises about 10 g/L Rucofin® GSQ; about 10 g/L Solusoft® SE 1 liq; and about 3 g/L Invadine® PBN for use by applying the fabric into the emulsion using a 20 ton pad roller in a stenter oven, where the fabric speed is about 55 m/min to about 70 m/min, at a temperature ranging from about 212° F. to about 390° F. The stenter machine also preferably is set for about 1.5 Barspad pressure and about 55% to about 65% liquid pick up for the fabric to be impregnated with pre-softening silicon emulsion.

Fabric Printing

Dyeing fabric is the most widely used technique for applying color to textiles. Dyeing by pigment coloration is economical because of the limited number of processing steps. In fact, dyeing may be achieved in one operation by applying a uniform shade to all fibers simultaneously. Another advantage of pigment coloration is the extensive range of colors and highlight fastness, while having satisfactory washfastness. Typically, optical brighteners such as for example, fluorescent brighteners or fluorescent brightening agents (FBA), which are colorless dyes that emit visible light when exposed to invisible ultra-violet light, are used to make white or light-colored fabrics appear brighter. However, optical brighteners should not be used when dyeing fabrics because these brighteners can interfere with some dyes by competing for the "dye sites" on the fibers.

There are various methods of printing colors in a definite, repeated pattern on fabric including, but not limited to, hand screen, automatic screen, rotary screen, roller, and heat transfer. Each of these methods may be used to print one or more print types. Screen printing involves coating a screen fabric made of, for example, nylon, polyester, or metal tightly mounted on a wooden or metal frame, with an opaque non-porous film with the design areas cut out. The screen may be placed on top of the fabric, print paste containing the colorant among other ingredients poured into the frame, and then the print paste is forced through the mesh. In this way, the print paste only passes through the fine mesh and coats the fabric in the areas of the design. Each color requires its own screen and separate application of color. Flatbed screen printing may be performed by hand or automatically. Rotary screen printing is a continuous, stepless image transfer method; whereas flatbed screen printing is a two-step process. Although flatbed screen printing is less expensive with respect to the equipment costs, the rate of production is slower than other printing processes. Rotary screen printing is ideal for coarse halftones and specialty inks. A preferred method of fabric printing is by rotary screen printing.

Print Paste

Briefly, the preferred fabric printing method utilizes rotary screen printing with a print paste composed of ingredients that provide the benefits of a fabric having a softer hand and brightly-colored print. One embodiment of the invention is directed to a pigment print paste or print paste formulation that comprises a high molecular weight synthetic thickener; an acrylic binder that has a low glass transition (Tg) temperature; a dispersing agent; a silicon base printing auxiliary; a silicon base printing emulsifier; a fatty acid softener; and an alkali. Also included are pigments that are specifically combined to provide the desired color as well as maintain the soft hand of the fabric that the inventive method produces.

Binder film hardness is known to depend on the glass transition temperature of a polymer. Glass transition temperature (Tg) of a non-crystalline material is the temperature at which the material changes its molecular conformation from hard and brittle to elastic and flexible. Since a thickener and binder with greater film hardness that forms a dried non-volatile material is known to contribute to a hard fabric hand, one of skill in the art having the present specification and claims before them would now understand that a high Tg polymer results in a harder film when dried; whereas, a low Tg acrylic binder polymer would produce a softer film when dry. Although low Tg polymers are commonly used in the coating industry, for example in paints that can tolerate dimensional fluctuations without cracking, low Tg acrylic binder polymers had not previously been used in the textile industry. These low-glass transition temperature polymers surprisingly provide excellent elasticity and flexibility in a print paste for conveying a soft hand to the fabric on which a print is applied. Moreover, the low Tg acrylic binder polymers cross-link with themselves to produce self cross-linking. The self cross-linked low glass transition temperature acrylic binders form a film on fibers or on the surface of the fibers of a fabric. This film is surprisingly elastic and flexible and contributes to a fabric having a soft hand.

With respect to thickeners, there are two types of thickeners commercially available—low molecular weight and high molecular weight. A print paste would require greater volume of a low molecular weight thickener than a high molecular weight thickener. For example, a low molecular weight thickener in an amount of about 3% to about 3.5% of the total print paste could be properly used, while a high molecular weight thickener in an amount of about 2% of the total print paste would generally be needed. Although either a low molecular weight thickener or a high molecular weight thickener may be used in the present invention, since less volume of the high molecular weight thickener is needed, it is advantageous to select a high molecular weight thickener to reduce the amount consumed and processed.

Print pastes for the fabric printing process varies depending on the print and colors desired for the design of the print. The preferred pigmentation or colors or pigments may be selected initially for producing the desired color palette needed for the print. Another factor to consider when selecting the appropriate pigments is the particle size of the pigment or combination of pigments. Pigments having the smallest allowable particle sizes that are yet large enough to achieve an acceptable depth of color are desirable. One of skill in the art would understand how to select the appropriate pigment or combination of pigments based on a pigment's chemical structure to achieve a sufficiently small particle size and desired color for producing a printed fabric having a soft hand. Pigments having a particle size or diameter or less than 1 μm, less than 0.5 μm, less than about 0.25 μm, less than about 0.1 μm, less than about 0.5 μm, or about 0.01 μm and greater than about 0.01 μm, greater than about 0.5 μm, greater than about 0.1 μm, greater than about 0.25 μm, greater than about 0.5 μm, or about 1 μm are preferred. Non-limiting examples of pigments having a sufficiently small particle size that when used in fabric printing results in a printed fabric having a soft hand include: Imperon® Black K-FBB (Dystar® Textilfarben GmbH; Leverkusen, Germany); Imperon® Blue K-B (Dystar® Textilfarben GmbH; Leverkusen, Germany); Imperon® Brilliant Pink K-3BL (Dystar® Textilfarben GmbH; Leverkusen, Germany); Imperon® Red K-B (Dystar® Textilfarben GmbH; Leverkusen, Germany); Imperon® Violet K-B (Dystar® Textilfarben GmbH; Leverkusen, Germany); Imperon® Yellow K-R (Dystar® Textilfarben GmbH; Leverkusen, Germany); and Imperon® White K-DRN (Dystar® Textilfarben GmbH; Leverkusen, Germany). Pigments are preferably selected from one or combinations of these pigments to obtain the desired color for fabric printing. For example, in order to obtain a green color, the combination of Imperon® Blue K-B and Imperon® Yellow K-R pigments is preferred over the green pigment, since a green pigment printed on fabric does not achieve the desired soft hand benefit. However, if a green pigment is available that fulfills all of the desired conditions, in particular particle size, that particular green pigment would be suitable for use in this fabric printing method and print paste. Thus combinations of pigments each having a particle size ranging from about 0.01 micrometer to about 1 micrometer is desirous over a single pigment having a particle size significantly greater than 1 micrometer.

More specifically, another embodiment is directed to a method of obtaining a first color; determining that the first color has an average first particle size; determining that the first color has the same appearance as a color produced by at least a second pigment and a third pigment, where the at least second pigment and third pigment each has an average particle size smaller than the average first particle size; and selecting the at least second pigment and third pigment to produce a color having the same appearance as the first color. The average first particle size preferably is greater than 1 micrometer. Whereas, the at least second pigment and third pigment each has an average particle size ranging from about 0.01 micrometer to about 1 micrometer.

Thus, in formulating a print paste that results in a fabric with a softer handle and preferably a brighter color print compared to a fabric produced by conventional methods, a low Tg temperature binder and a high molecular weight thickener are preferred. Generally, the preferred print paste comprises a low Tg temperature acrylic binder, such as a long chain acrylic polymer; a high molecular weight synthetic thickener, such as a high molecular weight acrylic polymer thickener; a dispersing agent; a silicone-containing printing emulsifier and auxiliary combination; a silicone-based printing auxiliary; a fatty acid softener; selected pigments; and mixed with water and adjusted for pH with liquid ammonia. Besides the binder, the thickener, and the softener, the additional components provide better strength to the print that is imprinted on the fabric. Essentially, these components provide better staying power or durability to the printing. These components act as pigment fixers for improving the quality in pigment printing. For example, the silicone-based auxiliary may improve the fastness of the prints to dry rubbing and yet produce a pleasantly dry, soft, and non-tacky handle. Moreover, a preferred silicone-based auxiliary also has been known to beneficially affect brilliance. These silicone-based auxiliary and combined emulsifier and auxiliary may be selected based on their properties which allow them for use in solvent-free or low-solvent pigment print pastes. By minimizing the solvent necessary in the entire process for producing a printed fabric having a soft hand and color brilliance, the waste produced is also decreased.

In one embodiment, a print paste comprises mixing less than 50 TDS water with the following components: 1) a low-glass transition temperature binder (low-glass transition polymer; long chain polymer acrylic with a solid content of about 30% to about 37%, and about 63% to about 70% water); 2) a liquid ammonia at 25% concentration sufficient to adjust to an alkaline pH, preferably about pH 9; 3) a high molecular weight thickener; 4) a dispersing agent; 5) a silicone-containing printing emulsifier and auxiliary combination; 6) a silicone-based printing auxiliary; and 7) a fatty acid based softener; 8) a surfactant, which enables flowability of the print paste, preferably an aqueous solution of an anionic acrylic polymer; and optionally, 9) a pigment fixer, such as but not limited to, melamine formaldehyde, a silicone-based printing auxiliary, or silicone-containing printing emulsifier and auxiliary combination. Additional components may include curing resins which assist in the curing step of the fabric printing process. Essentially, the resins act as binders for the pigments to bind to the fabric or cross-linked in a curing step. Since resins decrease the life expectancy of fabrics, ideally, less resin is preferably used. Another disadvantage of using resins may be the unavoidable production of hydrochloric acid (HCl) during curing. However, by lowering the curing temperature the process may be able to minimize the HCl production. The ability to lower the curing temperature is possible due to the use of one or more of the preferred steps outlined above, including the polymeric chain properites of the binder and resin. Moreover, a lower curing temperature results in less energy usage.

Regarding the application of the print paste, it is preferably applied to a pre-treated and pre-softened fabric using a rotary machine at ambient room temperature (about 20° C. to about 25° C.) and at a speed of about 55 m/min to about 70 m/min, but is a function of the complexity of the pattern to be printed. After the drying stage, the printed fabric proceeds to the stenter machine for finishing.

Finishing

Another embodiment is directed to a finishing step after the fabric printing occurs. Finishing is the final processing of the fabric in order to present the fabric suitable form for its intended final use. For example, textile finishes may be aesthetic finishes or functional finishes. Alternatively, they may also be characterized as chemical finishes or mechanical finishes. Finishes may change the appearance, drapability, and hand or feel of fabrics by including softeners or stiffeners such as starches. Other finishes may alter or create texture including embossing, brushing, napping, sueding, flocking, and the like. Another type of finish modifies the fabric luster, which may include beetling, calendering (simple, glazed, moiré, schereinering), and optical finishes (delusterants, optical brighteners). In contrast to these aesthetic finishes, the functional finishes improve the performance properties of the fabrics. For example, the care properties (durable press, soil-release, stain- and soil-resistance), comfort and safety (anti-static, chemical-protective, absorbent, flame-resistance, water-repellent, and waterproof), durability (abrasion-resistant, slip resistant, shrinkage control), and environmental protection (antimicrobial, fume fading inhibitors, metallic and plastic coatings, moth-proofing). For softening purposes, softening agents are frequently used to improve the hand and drape of a fabric. Commonly used softeners include, but are not limited to, oils, fats, wax emulsions, soaps, synthetic detergents, and silicone compounds or emulsions. Calendaring is another fabric luster finish. Essentially, this process produces a flat, glossy, and smooth surface by passing the fabric under pressure between cylinders such as in a calendaring machine.

In a specific embodiment, the fabric is processed in a stenter machine which applies a finishing emulsion to the printed fabric at a speed of 50 m/min, such that the liquid pick up is about 65%, the oven temperature ranges from about 212° F. to about 390° F., and the exhaust fans are open by about 50%. A further embodiment is directed to the finishing emulsion comprising a self-emulsifying silicon oil; a silicon macro-emulsion; and an emulsion of polyalkylene. In one embodiment, the finishing emulsion comprises: a hydrophilic, quaternary, non-reactive polysiloxane macroemulsion, such as for example, an aminofunctional polysiloxane polymer emulsion also containing non-ionic surfactants and glycols with special handle, high stability, and improved sewability (Rucofin® GSQ; Rudolf Chemie; Geretsried, Germany); a cationic, amino-functional nano-silicone, such as for example, a polysiloxane polymer (Solusoft® SE 1 liq; Clariant; Muttenz, Switzerland); and a non-ionic, polyalkylene emulsion (Turpex ACN NEW; Huntsman Textile Effects; Mumbai, India). A further preferred embodiment relates to a finishing emulsion comprising: a hydrophilic, quaternary, non-reactive polysiloxane macroemulsion, such as for example, an aminofunctional polysiloxane polymer emulsion also containing non-ionic surfactants and glycols with special handle, high stability, and improved sewability (Rucofin® GSQ; Rudolf Chemie; Geretsried, Germany); a wetting agent for pretreatment of textiles, such as for example, an ethoxylated fatty alcohol phosphate and araliphatic ether alcohol based surfactant (Invadine® PBN; Huntsman Chemical; The Woodlands, Tex.); and a non-ionic, polyalkylene emulsion (Turpex ACN NEW; Huntsman Textile Effects; Mumbai, India).

The printed fabric that has been finished may be cured in the stenter machine at a temperature of about 400° F. Curing may occur using a hot air oven alone or in combination with an infra-red radiation. In one embodiment curing uses hot air ranging in temperature from greater than about 212° F., greater than about 250° F., greater than about 280° F., greater than about 320° F., greater than about 360° F., to about 390° F. and less than about 390° F., less than about 360° F., less than about 320° F., less than about 280° F., less than about 2500° F., to about 212° F. When infra-red radiation is used, the temperature may preferably be about 1292° F.

Another embodiment is directed to a further finishing. After curing, the further finishing may involve calendering and sanforizing. As previously described, calendering in a calendering machine produes a shiny, smooth fabric. The fabric is processed at a temperature ranging from about 212° F. to about 220° F., under a steel bowl or roll pressure ranging from about 120 bars to about 125 bars, and under a cotton bowl pressure ranging from about 180 bars to about 185 bars. The final finishing may be directed to sanforizing which essentially fixes the fabric by stretching and shrink in order to reduce any shrinkage after the fabric is in the hands of the consumer. The sanforizing machine may have settings where the fabric moisture is about 25% to about 25% on the steel drum, a rubber sleeve drum temperature of about 212° F. to about 220° F., a sleeve pressure of about 13 bars, and a dryer drum temperature of about 220° F. to about 230° F.

Softer, Brighter Printed Fabric

The fabric printed using the method described here was evaluated for the feel or hand and compared to a fabric that was treated by conventional methods. Although a small sample size, all eight of the evaluators surveyed concluded that the method of producing a printed fabric with softer feel had a softer feel than the fabric produced by fabric printing. Multiple single blind tests were performed where evaluators surveyed various fabrics.

The printed fabric produced by the method described here is preferably fabric printed textile comprising: a self cross-linked low glass transition temperature acrylic binder film on fibers impregnated with a polysiloxane polymer. The finishing glossiness or sheen provides a film on the surface of the fabric. Qualities or characteristics of the finished fabric printed textile may be quantitatively or qualitatively determined using those techniques commonly known in the textile industry as well as those utilized in other industries, such as for example the polymer industry.

Green Technology Applications

The method described here may have several environmental impacts as well as advantages to the manufacturer. As an initial matter, the method described here from sizing, desizing, bleaching, pre-softening, fabric printing, and finishing eliminates several steps found necessary in conventional pretreatment and fabric printing processes. Not only does this reduce the time required for manufacturing the printed fabric, but in terms of costs, by faster production, more fabric is produced, enabling more fabric for sale. However, there is another environmental impact that beneficially reduces costs for the manufacturer. The eliminated steps are primarily wash steps. Textile finishing operations typically utilize about 6 to about 12 gallons of water per pound of fabric. However, the method described here drastically reduces the amount of water used to less than about 1.7 gallons/pound of fabric. In addition to eliminating particular steps, water may be reduced because of the recovery and reuse of sizing material used in the weaving or sizing process, the recycling of cooling water, and the reuse of some waste streams in some of the washing processes where the quality of water is not critical. In doing so, over about 50% of the treated wastewater may be reclaimed.

While various embodiments have been described above, it should be understood that such disclosures have been presented by way of example only and are not limiting. Thus, the breadth and scope of the subject methods, devices, and systems should not be limited by any of the above-described exemplary embodiments, but should be defined only in accordance with the following claims and their equivalents.

Having now fully described the subject methods, devices, and systems, it will be understood by those of ordinary skill in the art that the same can be performed within a wide and equivalent range of conditions, formulations and other parameters without affecting their scope or any embodiment thereof. All cited patents, patent applications and publications are fully incorporated by reference in their entirety.

EXAMPLES

Example 1

Sizing Method

Sizing occurred using a blend of 105 kg of a poly vinyl alcohol (Arkofil® STM gr; Clariant; Muttenz, Switzerland), 30 kg of an acrylic acid and vinyl acetate co-polymer dispersion (Arcofil® MSV 40% solid; Clariant; Muttenz, Switzerland), and 5 kg of a fatty acid polyglycol ester (Trefix® MSW fla; Clariant; Muttenz, Switzerland) in 860 liters of water. The size added on was 14-15% of fabric weight. The temperature ranged from about 160° F. to about 230° F., where the wax temperature was 160° F., the cooking and main cylinder temperatures were 195° F., and the other pre-cylinders had a temperature of 230° F. A speed of 60 meters/minute was used throughout the sizing procedure. The pressure throughout the sizing ranged from about 3 kilonewtons per square meter to about 7.5 kilonewtons per square meter.

Example 2

Pre-Softening Method

A silicon emulsion was prepared for application in the pre-softening step of the method described here. Essentially, the silicon emulsion impregnated into the fibers of a fabric to result in a swelling of the fibers. The swelling was accomplished by subjecting the fibers to a silicon emulsion containing about 10 g/L Rucofin® GSQ; about 10 g/L Solusoft® SE 1 liq; and about 3 g/L Invadine® PBN. The silicon emulsion or pre-softening emulsion was applied to the fabric using a 20 ton pad roller in a stenter machine, where the fabric speed was about 55 m/min to about 70 m/min, at a temperature ranging from about 212° F. to about 390° F. in the various chambers. The stenter machine also had settings of about 1.5 bars pad pressure and about 55% to about 65% liquid pick up for the fabric to be impregnated with pre-softening silicon emulsion.

Example 3

Print Paste

A pigment print paste formulation was prepared by preparing a stock paste formulation and then adding pigments to result in a print paste formulation that matches the desired color or color shade. In a tank having a capacity of 1700 liters, 1534 liters of water demineralized water of less than 50 TDS were mixed with 85 liters of a low Tg acrylic binder that is commercially available (Helizarin® Binder TOW; 35% solid contents; BASF SE; Ludwigshafen, Germany) and 8.5 liters of 25% liquid ammonia for adjusting the mixture to have an alkaline pH 9 (Mallinckrodt Baker B.V.; Deventer, The Netherlands). The mixture was stirred for 10 minutes at about 1400 rpm, at room temperature (about 20° C.-about 25° C. (or about 68° F.-about 77° F.)) under ambient atmospheric pressure of about latm in an open top kettle with a mounted mixer. After stirring, 25.5 liters of a high molecular weight acrylic polymer thickener (Lyoprint PT-RV; Huntsman International (I) Pvt. Ltd.; Mumbai, India), 2 liters of a dispersing agent (Lyoprint PDN; Huntsman Textile Effects; Basel, Switzerland), 15 liters of a silicone-containing printing emulsifier and auxiliary combination (Luprintol® multifunction AB 401; BASF SE; Ludwigshafen, Germany), 15 liters of a silicone-based printing auxiliary (Luprimol® SIG; BASF Aktiengesellschaft; Ludwigshafen, Germany), and a 15 liters of a fatty acid softener (Belsoft 200 CONC-PI; Pulcra Chemicals GmbH; Monheim am Rhein, Germany or preferably, Alkasoft GDS (30% concentrated); Alka (Pvt.) Ltd; Faisalabad, Pakistan). The mixture was stirred for 45 minutes and then the resulting paste was transferred to a stock tank.

An appropriate amount of pigment was added to obtain the desired color. The pigments were selected from: Imperon® Black K-FBB (Dystar® Textilfarben GmbH; Leverkusen, Germany); Imperon® Blue K-B (Dystar® Textilfarben GmbH; Leverkusen, Germany); Imperon® Brilliant Pink K-3BL (Dystar® Textilfarben GmbH; Leverkusen, Germany); Imperon® Red K-B (Dystar® Textilfarben GmbH; Leverkusen, Germany); Imperon® Violet K-B (Dystar® Textilfarben GmbH; Leverkusen, Germany); Imperon® Yellow K-R (Dystar® Textilfarben GmbH; Leverkusen, Germany); and Imperon® White K-DRN (Dystar® Textilfarben GmbH; Leverkusen, Germany). Any combinations of pigments were matched against the standard desired color. The selected pigment or pigments were stirred for about 5 minutes with the stock paste formulation and bands of the particular shades were matched with a standard. The pigmented print paste was then applied to the rotary screen for fabric printing.

What is claimed:

1. A method for textile processing, comprising:

a) sizing a yarn to weave fabric;

b) desizing the sized fabric;

c) bleaching the desized fabric;

d) reducing the number of electrolytes on the bleached fabric;

e) pre-softening the fabric having fewer electrolytes;

f) fabric printing the pre-softened fabric; and g) finishing the fabric printed fabric, wherein the pre-softening comprises applying a pre-softening emulsion comprising:

an aminofunctional polysiloxane polymer emulsion;

a cationic, amino-functional nano-silicone; and an ethoxylated fatty alcohol phosphate and araliphatic ether alcohol based surfactant.

2. The method of claim 1, wherein sizing comprises recoverable sizing materials.

3. The method of claim 2, wherein the recoverable sizing materials are selected from the group consisting of: a polyvinyl alcohol, a polyvinyl acetate, a sodium carboxymethyl cellulose, an acrylic, a partially hydrolyzed poly vinyl alcohol, an acrylic-vinyl acetate co-polymer, a castor oil-based softener, and combinations thereof.

4. The method of claim 3, wherein the sized fabric is desized until the fabric is completely desized of sizing materials.

5. The method of claim 4, wherein desizing the fabric comprises soaking the fabric in ultra filtration-recovered water at a temperature ranging from about 208° F. to about 215° F.

6. The method of claim 5, wherein the bleaching step comprises bleaching with a bleaching solution comprising an oxidizing bleaching agent, a caustic soda, a bleaching stabilizer, and a wetting agent, wherein the bleaching solution is neutralized with acetic acid to about pH 6.5 to about pH 7.

7. The method of claim 6, wherein the bleaching step further comprises steaming the bleached fabric with water.

8. The method of claim 7, wherein the reducing step occurs by washing the steamed fabric with demineralized water.

9. The method of claim 1, wherein fabric printing the pre-softened fabric comprises applying a print paste comprising: a low-glass transition temperature long chain acrylic polymer binder; a high molecular weight acrylic polymer thickener; a dispersing agent; a silicone-containing printing emulsifier and auxiliary combination; a silicone-based printing auxiliary; a fatty acid based softener; and a pigment.

10. The method of claim 9 wherein each of the one or more than one pigment has a particle size ranging from about 0.01 micrometer to about 1 micrometer.

11. The method of claim 10, comprising more than one pigment.

12. The method of claim 10, wherein the print paste comprising more than one pigment produces a similar color to a pigment having a particle size greater than 1 micrometer.

13. The method of claim 10, wherein finishing the printed fabric comprises applying a finishing emulsion comprising a hydrophilic, quaternary, non-reactive polysiloxane macro-emulsion; an ethoxylated fatty alcohol phosphate and araliphatic ether alcohol based surfactant; and a non-ionic, polyalkylene emulsion.

14. The method of claim 13, wherein the finishing step further comprises curing the finished fabric under hot air, infra-red radiation, or a combination thereof.

15. The method of claim 14, wherein the cured fabric is further finished by calendering and sanforizing.

16. A method for processing a fabric comprising:

a) desizing a fabric;

b) bleaching the desized fabric;

c) reducing electrolytes on the bleached fabric;

d) pre-softening the reduced-electrolyte fabric;

e) printing ore or more than one pigment onto the pre-softened fabric; and f) finishing the fabric printed fabric;

wherein the pre-softening comprises applying a pre-softening emulsion comprising:

an aminofunctional polysiloxane polymer emulsion;

a cationic, amino-functional nano-silicone; and an ethoxylated fatty alcohol phosphate and araliphatic ether alcohol based surfactant.

17. The method of claim 16, wherein fabric printing the pre-softened fabric comprises applying a print paste comprising: a low-glass transition temperature long chain acrylic polymer binder; a high moelecular weight acrylic polymer thickener; a dispersing agent; a silicone-containing printing emulsifier and auxiliary combination; a silicone-based printing auxiliary; a fatty acide based softener; and one or more than one pigment.

18. The method of claim 17 wherein each of the one or more than one pigment comprises particles having a size ranging from about 0.01 micrometer to about 1micrometer.

19. The method of claim 18 comprising more than one pigment.

20. The method of claim 19 wherein the print paste comprising more than one pigment produces a similar color to a pigment having a particle size greater than 1 micrometer.

21. The method of claim 16 wherein finishing the printed fabric comprises applying a finishing emulsion comprising a hydrophilic, quaternary, non-reactive polysiloxane macro-emulsion; an ethoxylated fatty alcohol phosphasted and araliphatic ether alcohol base surfactant; and a non-ionic, polyalkylene emulsion.

22. The method of claim 21 wherein the finishing step further comprises curing the finished fabric under hot air, infra-red radiation, or a combination thereof.

23. The method of claim 22 wherein the cured fabric is further finished by calendaring and sanforizing.

* * * * *